United States Patent [19]

Janhonen

[11] Patent Number: 4,757,666

[45] Date of Patent: Jul. 19, 1988

[54] APPARATUS FOR FOLDING AND CLOSING A BLANK OF WRAPPING MATERIAL AROUND AN ARTICLE TO BE PACKAGED

[76] Inventor: Veikko I. Janhonen, Långvik, 02420 Jorvas, Finland

[21] Appl. No.: 20,854

[22] Filed: Mar. 2, 1987

[30] Foreign Application Priority Data

Dec. 17, 1986 [FI] Finland ..... 865138

[51] Int. Cl.[4] ..... B65B 13/20

[52] U.S. Cl. ..... 53/176; 53/218; 53/528

[58] Field of Search ..... 53/176, 170, 218, 528, 53/523, 449, 461, 472, 203

[56] References Cited

U.S. PATENT DOCUMENTS

| | | | |
|---|---|---|---|
| 1,117,129 | 11/1914 | Giroud | 53/176 |
| 2,050,714 | 8/1936 | Malocsay | 53/176 |
| 2,802,321 | 8/1957 | Abbott | 53/176 X |
| 3,237,373 | 3/1966 | Lewis | 53/218 X |

FOREIGN PATENT DOCUMENTS

| | | |
|---|---|---|
| 388333 | 1/1924 | Fed. Rep. of Germany . |
| 205368 | 11/1973 | Finland . |
| 70392 | 3/1986 | Finland . |
| 485551 | 2/1970 | Switzerland . |

*Primary Examiner*—James F. Coan

*Attorney, Agent, or Firm*—Knobbe, Martens, Olson & Bear

[57] ABSTRACT

The invention relates to an apparatus for wrapping and closing a blank (1) of wrapping material around an article to be packaged. The wrapping blank consists of a rectangular piece of protective cardboard (3, 4), serving as an outer jacket for the package, and of a wrapper element (2) fastened to the other surface of said protective cardboard and wrappable around an article. The side edges of a package are closable by folding both ends (3, 4) of protective cardboard around the side edges of an article. Folding the ends of a protective cardboard manually strains the wrists of a packing person which is why this working step is automated by means of an apparatus comprising a mechanism for folding the ends (3, 4) of a protective cardboard, a conveyor track (5, 13) and pusher elements (32) that can be reciprocally driven on either side of the center axis of said conveyor track, and press elements (22) therebelow for pressing the side edges of a package while said pusher elements (32) travel along the top surface of a package.

14 Claims, 2 Drawing Sheets

APPARATUS FOR FOLDING AND CLOSING A BLANK OF WRAPPING MATERIAL AROUND AN ARTICLE TO BE PACKAGED

The present invention relates to an apparatus for folding and closing a blank of wrapping material around an article to be packaged, said blank of wrapping material comprising a rectangular piece of protective cardboard serving as an outer jacket of the package and a wrapper element, fastened to the other surface of said protective cardboard and wrappable around an article, and the sides of such a package can be closed by folding both ends of the protective cardboard around the side edges of an article, said apparatus comprising a mechanism for folding the ends of protective cardboard, said mechanism comprising a conveyor line and pusher elements on either side of its centre axis and movable towards and away from each other by means of a power unit and in whose position away from each other said blank of wrapping material can be conveyed in between said pusher elements for closing the package by driving the pusher elements towards each other.

The above-described wrapping blanks have become very popular e.g. for wrapping up books for mailing. One particular advantage of such a package is that, in spite of its simple and material-saving construction, the size, volume and shape of such package can be adapted to highly varying goods. Thus, one and the same wrapping blank can be used for packaging one or a plurality of books and the sizes of books may be very different. Placing the articles to be parceled on a wrapping blank and closing the wrapping blank to form a finished package has been manual work. In a way this is natural because in most cases the goods to be mailed are sorted out as manual labour and they can be placed on a wrapping blank during the assortment.

However, in closing the package manually, it has been found difficult to fold the ends of a protective cardboard around the side edges of a package and to press and hold the folded cardboard ends firmly against the surface of a package while pushing the package into a binding strip wrapping mechanism for winding and fastening a binding strip around the package. The package can also be closed by gluing but, being manual work, that is slow and expensive. In order to obtain a firm package, the package must be subjected to major compressive forces when folding the ends of protective cardboard and the overlapping ends of a protective cardboard must be pulled towards each other. In practice, it has been found that it is just this working step that causes overstrain and pain in the packers' wrists.

On the other hand, a plurality of package closing machines are known in the art but so far there has been no machine that would be suitable for closing the above type of packages with varying width and thickness. For example, DE patent specification No. 388 333 deals with wrapping a strip around thin, standard-size leaflets. This apparatus would not be suitable for closing book packages of varying widths and heights.

An object of the invention is to provide an apparatus for closing the above type of packages of varying widths and heights in a manner that said wrist-stressing working step can be performed mechanically.

This object is achieved by means of an apparatus of the invention on the basis of the characterizing features set out in the annexed claims.

One embodiment of the invention will now be described with reference made to the accompanying drawings, in which FIG. 1 shows an apparatus of the invention in the driving direction of a conveyor line, with the conveyor line shown in cross-section.

Prior to describing the apparatus, reference will be made to a wrapping blank which the development of this present apparatus is based on. The present package or wrapping blank is described in more detail in the Applicant's International patent application WO No. 83/02764. The wrapping blank comprises a rectangular piece of protective cardboard 3, 4 with a wrapping paper 2 fixed to one side thereof in the central area crosswise of cardboard 2. Thus, the ends of a package can be closed by folding first the ends of wrapping paper 2 around the end edges of an article, the length of paper 2 being selected sufficient so that its ends extend to overlap each other and can be fixed to each other e.g. by an adhesive tape.

Thereafter, the side edges of a package can be closed by folding both ends 3, 4 of protective cardboard around the side edges of an article. Also the ends 3, 4 of protective cardboard will then overlap each other.

Figure 2:
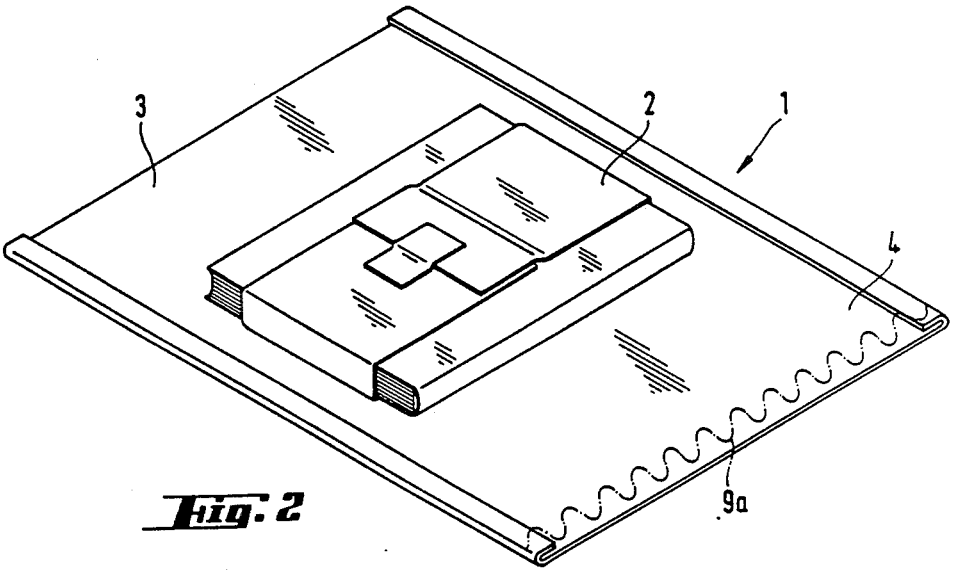
FIG. 2 shows a package to be closed by means of an apparatus of the invention.

The wrapping or package blanks 1, whose wrapping paper 2 is closed as shown in FIG. 2, are placed on a conveyor line or track 5. Said track 5 can consist of rollers or endless chains, the lugs projecting therefrom pushing the wrapping blank 1 forward along a flat surface.

Alongside the conveyor track 5 there is a hot-setting adhesive station 6 which, as seen in conveying direction, is located upstream of a package closing or sealing station. The hot-setting adhesive station 6 is supported on guide bars 7 extending transversely to the conveying direction of track 5 by means of a slide block 7*a*, the latter being movable on guide bars 7 by means of a piston-cylinder unit 8. Extending through said slide block 7*a* are second guide bars 11, whose end is fitted with a flat bar to carry a hot-setting adhesive metering device provided with a nozzle 9. The hot-setting adhesive is delivered under pressure from a hot-setting adhesive heating station, not shown, to a dispenser which is provided with a magnetic valve to open and close a duct leading to nozzle 9. The slide blcok 7*a* is fitted with a piston-cylinder unit 10 whose piston rod is fastened to said adhesive dispenser. A double-action cylinder 10 is provided with magnetic valves (not shown) which can be alternately controlled to open and close for moving adhesive dispenser and its nozzle 9 back and forth so as to build a winding adhesive streak upon the edge 4 of a packing cardboard advancing below said nozzle 9, as shown in FIG. 1B.

Associated with slide block 7*a* and mounted on the end of a bar 12*a* is an electric eye 12 which monitors the edge of a wrapping blank end 4 while said hot-setting adhesive station 6 is carried by a power unit 8 along guide bars 7. When said electric eye 12 observes the edge of a wrapping blank, the hot-setting adhesive station 6 stops its movement on guides 7. This process of finding a position for the hot-setting adhesive station occurs with conveyor 5 stationary and one wrapping blank at a package closing station in the process of being closed. As the closing of a package is completed and the conveyor commences its movement. the leading edge of wrapping blank 1 at the hot-setting adhesive station 6 runs into an electric eye (not shown) provided on track 5 for opening said adhesive nozzle 9 and actuating the reciprocating movement of cylinder 10, the winding adhesive seam being formed on the inner surface of one end 4 of the protective cardboard of wrapping blank 1 immediately before said wrapping blank proceeds into the package closing station. As the trailing end of wrapping blank 1 passes by said electric eye on track 5, said adhesive nozzle 9 is shut off and the piston of cylinder 10 comes to a stop. The power unit 8 pulls the hot-setting adhesive station 6 to its end position towards track 5 to wait for the arrival of a fresh wrapping blank.

The just glued wrapping blank proceeds forward onto a track section 13. At this time, said track section 13 is elevated to the level of the rest of the conveyor track 5 by means of a piston-cylinder unit 16, 17.

The structure of a package closing station will be explained next. A conveyor track section 13 provided at the closing station consists of rollers 15 journalled on shafts 14 which are spaced from each other by a gap extending in the conveying direction. The ends of a rail **14*a* bearing said shafts 14 can be supported by means of slide rods into sliding sleeves (not shown) provided on the frame. Thus, the track section 13 can be of sufficient length and a load that is asymmetrical relative to a piston rod 16 does not stress said piston rod 16**.

Above the track section 13 is mounted a press means 18, supported by slide rods 18 into the sliding sleeves mounted on the frame and adapted to be reciprocated in vertical direction by means of a piston-cylinder unit 20.

Holder means 22 for the side edges of a package to be closed consist of upright bars or rails, positioned in a manner that they are able to find their way in between rollers 15 which are located successively in the conveying direction of conveyor 13. Holder means 22 are mounted on a slide cradle 23, supported by slide guides 24 on slide bars 25. The number of slide bars 25 is two and they are spaced from each other in the conveying direction and slide cradle extends between slide bars 25 in a direction perpendicular to the plane of the drawing.

A piston-cylinder unit 26 is adapted to move slide cradles 23 towards and away from each other. For having each slide cradle 23 travel an equal distance and symmetrically relative to the centre axis of the conveyor track, around sprockets 27 is passed an endless chain 28 whose lower run is at 29 fastened to the right-hand side slide cradle 23 and upper run at 30 fastened to the left-hand side slide cradle 23.

Upon the same slide bars 25, above slide cradles 23 are arranged second slide cradles 31 which, at the ends of finger-shaped projections, carry pusher rollers 32 e.g. in a manner that above each holder rod 22 there is one pusher roller 32. The total number of these can be e.g. 4 to 8, arranged successively in the conveying direction.

The piston rod of a piston-cylinder unit 33 is connected to the upper slide cradle 31 and the cylinder end to the lower slide cradle 23, as shown with a dot-dash line 34.

Figure 1:
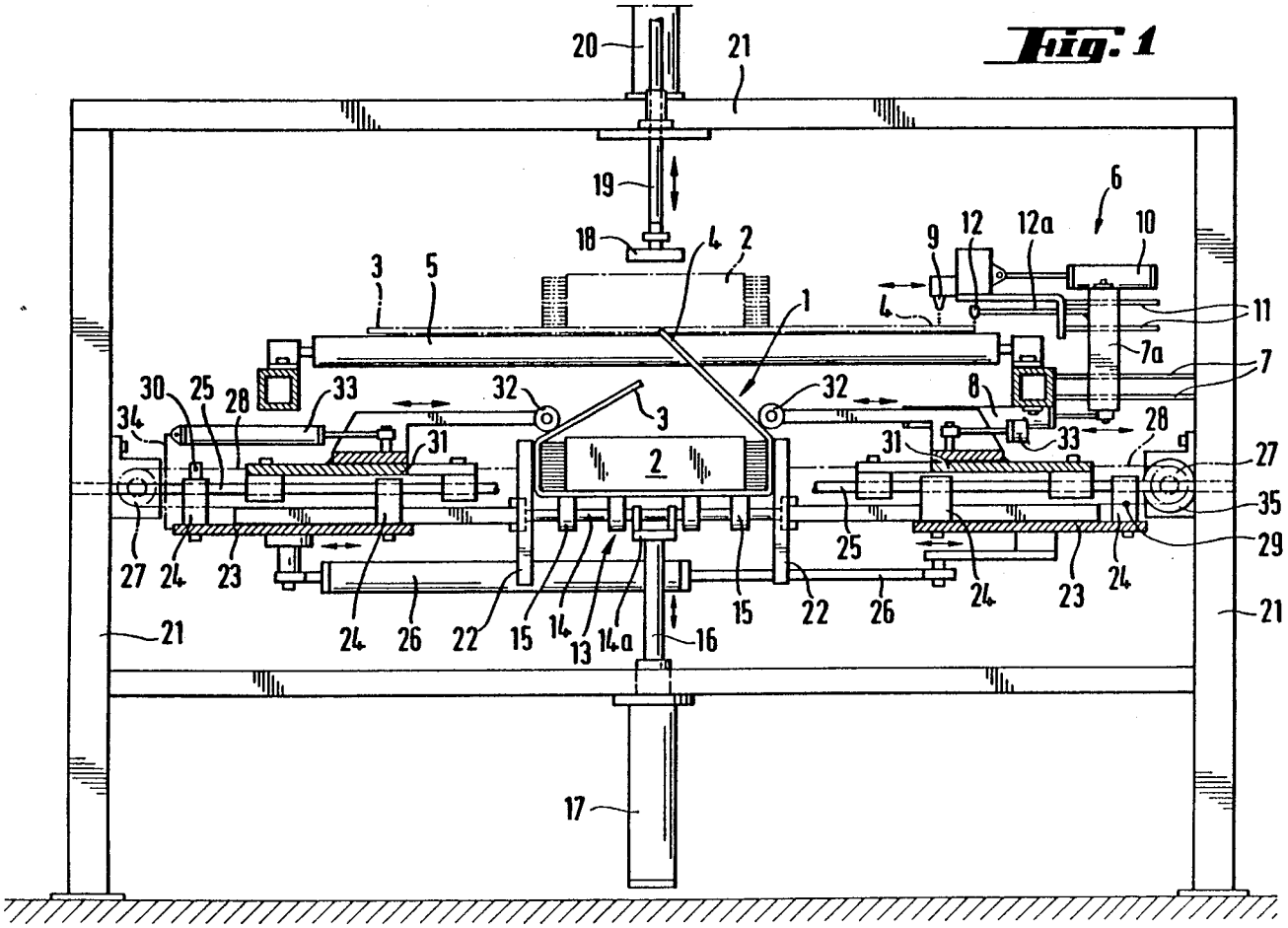
FIG. 1A shows a detail in the apparatus shown in FIG. 1.
FIG. 1B shows the location of a glue orifice 9 and an electric eye 12 relative to the edge of a blank of wrapping material.
Figure 1A:
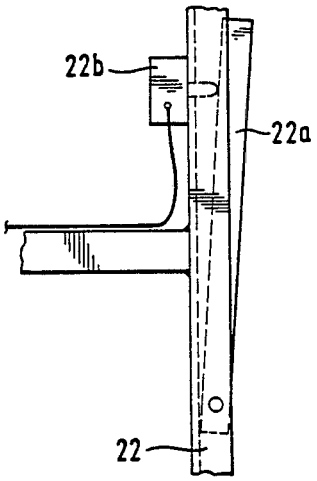
Figure 1B:
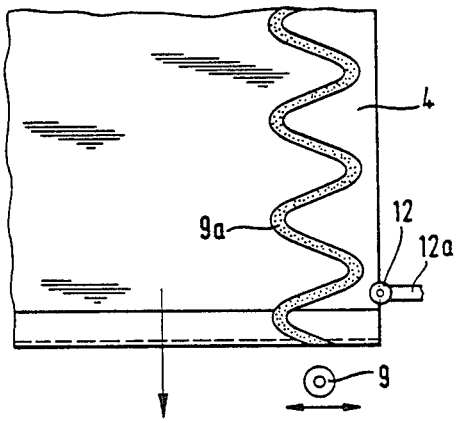

As shown in FIG. 1A, one of the holder rods 22 is fitted with a pivoted lever **22*a* which controls a micro-switch 22*b*. The operation of lever 22*a* is so pre-biased that lever 22*a* must be pressed with force exceeding a certain force in order to actuate micro-switch 22*b***. This force is preferably adjustable (e.g. by adjusting spring load) and selectable in a manner that said force exceeds the force required for moving a package sideways.

In addition, the right-hand sprocket 27 is provided with a magnetic disc brake 35 for stopping slide cradles 23 and holder rods 22 at a precisely set position.

Closing or sealing the package is performed as follows. When a wrapping or package blank has completely moved over onto a conveyor section 13, which is verified by means of a pneumatic or electric sensor, a press element 18 is pressed on top of the package. Prior to that, said pusher rollers 32 are carried by means of piston-cylinder unit 33 to its rearwards position, at which they lie on top of the ends of holder rods 22. By means of piston-cylinder unit 26, said holder rods 22 (and at the same time rollers 32) have been positioned at a mutual distance that slightly exceeds the width of a package being built. This distance is always preset according to an article to be wrapped.

Track 13 is lowered while using press element 18 to hold the package in contact with track 13. Then, the cardboard side edges 3 and 4 turn to an upright position, forced by rollers 32 and holder rods 22. At this time, the package may still lie asymmetrically relative to the conveyor centre axis (packages are manually laid on conveyor). For this reason, the distance between rollers 32 and holder rods 22 must sufficiently exceed the width of a package to make sure that the package finds its way therebetween. Track 13 is lowered to such a level that the top surface of a package will be flush with the bottom sides of rollers 32. This can be pre-set according to the thickness of an article to be wrapped. It is also possible to arrange automatic measuring of the height of an article to be wrapped for determining the depth to which conveyor 13 is lowered. Thus, goods with constantly varying height can be run through the apparatus.

The following step is to perform the pressing of the side edges of a package. Thus, piston-cylinder unit 26 is operated to drive slide cradles 23 and holder rods 22 closer to each other until a switch **22*a*, 22*b* stops the movement of piston-cylinder unit 26 and at the same time switches on a brake 35**. At this time, the package has moved into a centered position and its sides are tightly compressed.

At the following stage, piston-cylinder units 33 are operated to drive pusher rollers 32 for folding cardboard flaps 3 and 4 onto the top side of the package. What must be considered in timing the operation of piston-cylinder units 33 is that the cardboard side edge 4, on which the adhesive has been sprayed, will be folded a little later to bring it on top. However, with rollers 32 continuing their movement, the roller that has started first must be stopped or decelerated so it would not go under the side flap 4 before said side flap is pressed fast to the top surface of side flap 3. At the beginning of folding said flaps 3 and 4, said press means 18 is lifted up.

Since, during their return run, the distance between said pusher rollers 32 exceeds the width of press element 18, said press element 18 is immediately pressed against the top surface of a closed package. Rollers 32 and holder means 22 are moved aside off the package and conveyor track section 13 is lifted up back to the level of conveyor track 5. During this time, said press element 18 urges flap 4 against flap 3 and secures tenability of the adhesive seam. Since the hot-setting adhesive used for gluing becomes tenable very quickly upon cooling, a closed package can be driven forward without delay.

During the package closing procedure, the hot-setting adhesive was applied to the edge of a preceding package and, at the same time a package is carried out of the closing station, a fresh wrapping or package blank is brought into the closing station.

I claim:

1. An apparatus for wrapping and closing a blank (1) of wrapping material around an article to be packaged, said wrapping blank consisting of a rectangular piece of protective cardboard (3, 4) serving as an outer jacket of the package and of a wrapper element (2), fastened to said protective cardboard and wrappable around an article, and the side edges of such a package can be closed by folding both ends (3, 4) of protective cardboard around the side edges of an article, said apparatus comprising a mechanism for folding the ends (3, 4) of protective cardboard, said mechanism comprising a conveyor track (5, 13) and pusher (32) on either side of its centre axis and movable towards and away from each other by means of a power unit (33) and, in whose position away from each other, said wrapping blank (1) can be conveyed in between said pusher elements (32) for closing the package by driving pusher elements (32) towards each other, characterized in that below said pusher elements (32) are provided holder means (22) adapted to be driven by a power unit (26, 28) towards and away from each other, that pusher elements (32) are adapted to be carried along with holder means (22) and also to be driven by their own power unit (33) relative to holder means (22) in a manner that, as said holder means (22) run against the side edges of package (1) and stop their movement, said pusher elements (32) continue their movement along the top surface of said package, that pusher elements (32) and holder means (22) and a section (13) of the conveyor track aligned therewith are adapted to be movable relative to each other in vertical direction and that above this track section (13) is arranged a press element (18) that can be lifted up and lowered down.

2. An apparatus as set forth in claim 1, characterized in that said holder means (22) are fastened to a slide cradle (23) which is movable along slide bars (25) on its slide guides (24).

3. An apparatus as set forth in claim 2, characterized in that the opposite ends of a piston-cylinder unit (26) are connected to slide cradles (23) and that the upper run of an endless chain (28) (at 30) is connected to one slide cradle (23) and the lower run (at 29) to the other slide cradle (23).

4. An apparatus as set forth in claim 2 or 3, characterized in that said pusher elements (32) are fastened to a slide cradle (31) mounted above said slide cradle (28) and movable along the same slide bars (25) as the lower slide cradle (28).

5. An apparatus as set forth in claim 4, characterized in that one end of piston-cylinder unit (33), which serves to move pusher elements (32), is fastened to upper slide cradle (31) and the other end is fastened (34) to lower slide cradle (28).

6. An apparatus as set forth in any of claims 2 or 3, characterized in that a slide bar (25) for slide cradles (23, 31) is mounted on a frame (21) and said track section (13) is adapted to be lifted and lowered by means of a piston-cylinder unit (16, 17).

7. An apparatus as set forth in claim 1, characterized in that said holder means (22) are provided with a switch means (22*a*, 22*b*) for stopping the movement of holder means (22) when said holder means run against the sides of a package with a force that exceeds the force required for moving the package sideways.

8. An apparatus as set forth in claim 1, characterized in that said press element (18) is adapted to rest against the top surface of an open package brought into the wrapping station while said track section (13) moves downwards for bringing a package (1) from the conveyor track level in between pusher and holder elements (32 and 22), whereafter said press element (18) rises up for the action of holder means (22) and pusher elements (32) and is adapted to be pressed against the top surface of a closed package immediately as soon as, during their return movement, the distance between pusher elements (32) exceeds the width of press element (18), and said press element (18) is maintained against the top surface of a closed package for as long as it takes to bring the package supporting track section back to the conveyor track level.

9. An apparatus as set forth in claim 1, characterized in that alongside said conveyor track (5), in the conveying direction upstream of pusher elements (32), there is provided a hot-setting adhesive station (6) supported upon guide bars (7), which are transverse relative to the conveyor track, and fitted with an electric eye (12) monitoring the edge of wrapping blank (1), that a power unit (8) is adapted to carry said hot-setting adhesive station (6) along guide bars (7) until the edge of wrapping blank (1) becomes aligned with electric eye (12), and that said hot-setting adhesive station (6) is located alongside pusher elements (32) in a manner that, as the leading one of two successive wrapping blanks (1) is aligned with pusher elements (32) at the package closing station, the leading edge area of a trailing one is aligned with electric eye (12) and a hot-setting adhesive nozzle (9), seen in the conveying direction, is located closer to pusher elements (32) and, as seen in direction transverse to the track, closer to conveyor track in than said electric eye (12).

10. An apparatus as set forth in claim 9, characterized in that the power units (33) for pusher elements (32) facing each other are controlled to commence their working stroke at different times, so that the pusher element (32) located on the same side of the conveyor track as hot-setting adhesive station (6) performs its working stroke at a later time.

11. An apparatus as set forth in claim 4, characterized in that a slide bar (25) for slide cradles (23, 31) is mounted on a frame (21) and said track section (13) is adapted to be lifted and lowered by means of a piston-cylinder unit (16, 17).

12. An apparatus as set forth in claim 11, characterized in that said press element (18) is adapted to rest against the top surface of an open package brought into the wrapping station while said track section (13) moves downward for bringing a package (1) from the conveyor track level in between pusher and holder elements (32, 22), whereafter said press element (18) rises up for the action of holder means (22) and pusher elements (32), and is adapted to be pressed against the top surface of a closed package immediately as soon as, during the return movement, the distance between pusher elements (32) exceeds the width of press element (18), and said press element (18) is maintained against the top surface of a closed package for as long as it takes to bring the package-supporting track section back to the conveyor track level.

13. An apparatus as set forth in claim 13, characterized in that a slide bar (25) for slide cradles (23, 31) is mounted on a frame (21) and said track section (13) is adapted to be lifted and lowered by means of a piston-cylinder unit (16, 17).

14. An apparatus as set forth in claim 13, characterized in that said press element (18) is adapted to rest against the top surface of an open package brought into the wrapping station while said track section (13) moves downward for bringing a package (1) from the conveyor track level in between pusher and holder elements (32, 22), whereafter said press element (18) rises up for the action of holder means (22) and pusher elements (32), and is adapted to be pressed against the top surface of a closed package immediately as soon as, during the return movement, the distance between pusher elements (32) exceeds the width of press element (18), and said press element (18) is maintained against the top surface of a closed package for as long as it takes to bring the package-supporting track section back to the conveyor track level.

* * * * *